US005546062A

United States Patent [19]

Duchemin

[11] Patent Number: 5,546,062

[45] Date of Patent: Aug. 13, 1996

[54] PROTECTION SWITCH

[75] Inventor: Pierre Duchemin, Fourqueux, France

[73] Assignee: Schneider Electric SA, Boulogne-Billancourt, France

[21] Appl. No.: 317,740

[22] Filed: Oct. 4, 1994

[51] Int. Cl.[6] ..... H01H 67/02

[52] U.S. Cl. ..... 335/132; 335/105

[58] Field of Search ..... 335/131–132, 335/42, 45, 90, 157, 193, 105

[56] References Cited

U.S. PATENT DOCUMENTS

| | | | |
|---|---|---|---|
| 3,671,891 | 6/1972 | Usui et al. | 335/126 |
| 3,882,435 | 5/1975 | Grass et al. | 335/164 |

FOREIGN PATENT DOCUMENTS

| | | |
|---|---|---|
| 0174467 | 3/1986 | European Pat. Off. . |
| 0486389 | 5/1992 | European Pat. Off. . |

*Primary Examiner*—Lincoln Donovan
*Attorney, Agent, or Firm*—Oblon, Spivak, McClelland, Maier & Neustadt

[57] ABSTRACT

A contactor/protection relay type protection switch comprises at least one power pole comprising a mobile contact holder cooperating with fixed contacts. It can be moved by an operating lever coupled to moving parts of a solenoid. The switch includes an elastic device between the end of the lever coupled to the solenoid and a plunger of the contact holder.

5 Claims, 3 Drawing Sheets

Fig. 1
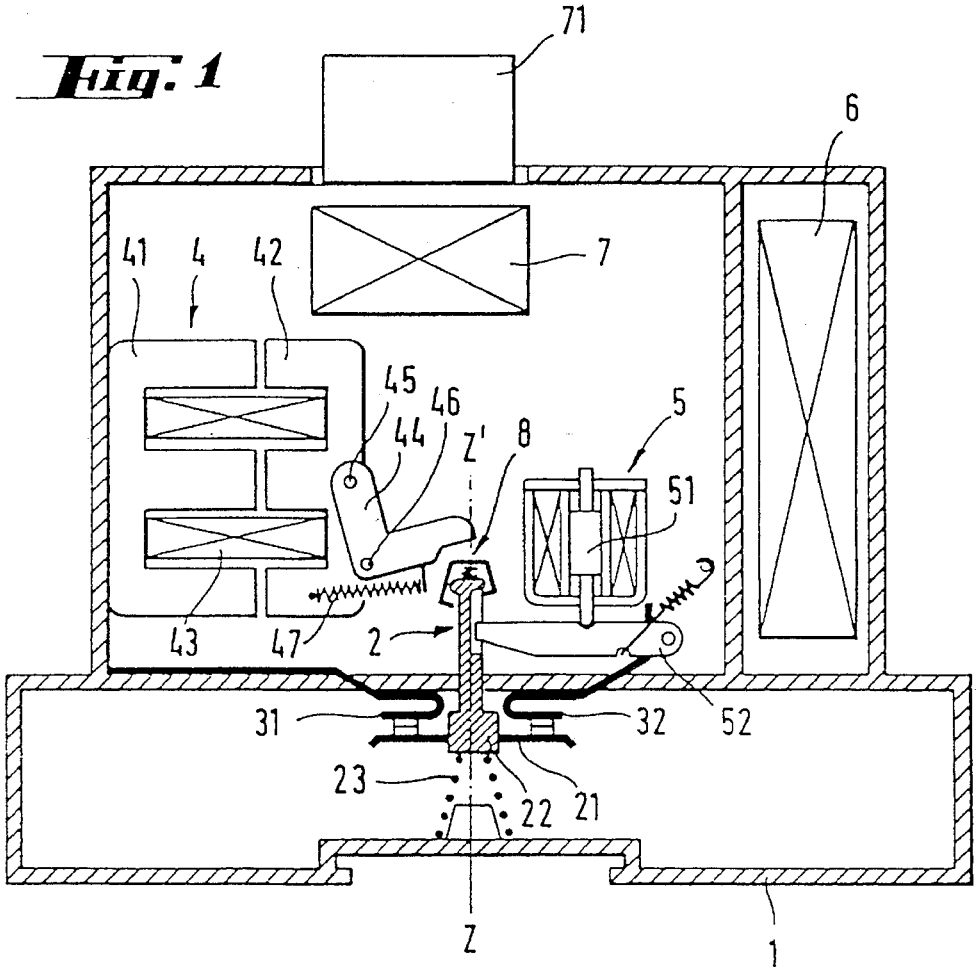
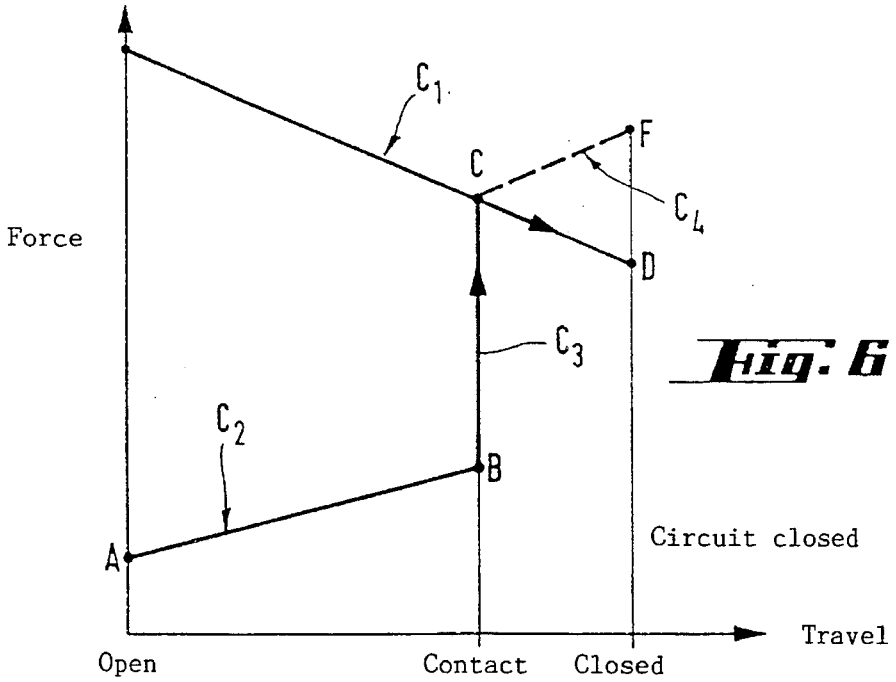
Fig. 6

PROTECTION SWITCH

BACKGROUND OF THE INVENTION

1. Field of the Invention

The present invention concerns a protection switch comprising at least one power pole comprising a mobile contact holder cooperating with fixed contacts and adapted to be moved by an operating lever coupled to the moving parts of a solenoid.

2. Description of the Prior Art

Contactor/protection relay type protection devices combine in the same casing a contactor and a current limiter resettable protection relay to protect against short-circuits. A magneto-thermal protection module is adapted to cause the contacts to be opened in response to an overload or current surge.

To increase the rating of the device it is necessary to increase the pole contact pressure in response to loads due to the required nominal current, but the solenoid is not open to such modification.

An object of the present invention is to increase the rating of a contactor/protection relay type device but to retain a solenoid suited to a lower rating.

SUMMARY OF THE INVENTION

A switch in accordance with the invention comprises an elastic device disposed between the end of the lever coupled to the solenoid and the plunger of the contact holder.

In accordance with one feature of the invention the elastic device comprises an end-piece mounted at the free end of the plunger and associated with a spring compressed between said end-piece and said plunger.

In accordance with one feature of the invention the elastic device has means for preventing separation of the end-piece and the plunger.

In accordance with one feature of the invention the end-piece carries an abutment limiting travel of the end-piece towards the plunger.

The invention is next described in more detail with reference to one embodiment of the invention shown by way of example in the appended drawings.

BRIEF DESCRIPTION OF THE DRAWINGS

FIG. 1 is a diagrammatic view n cross-section of the device of the invention

FIG. 6 is a diagram showing force as a function of travel.

DETAILED DESCRIPTION OF THE PREFERRED EMBODIMENT

Figure 2:
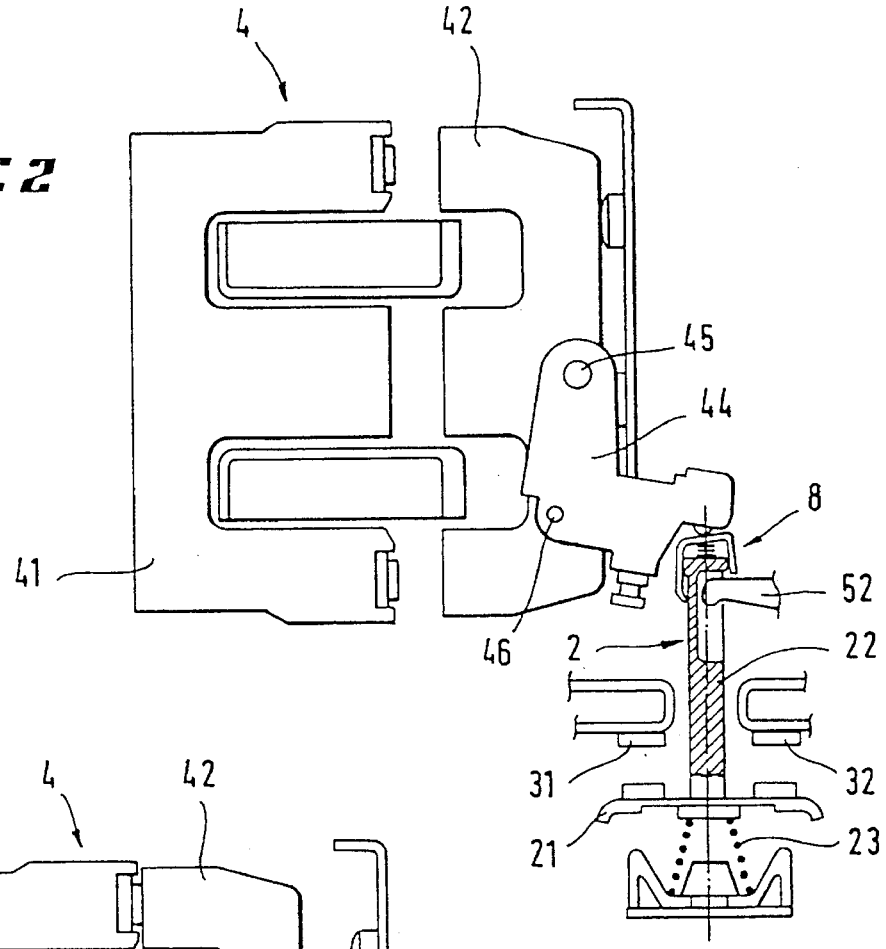
FIG. 2 is a view in cross-section of the contact operating mechanism with the contacts open.

The device shown in FIG. 1 is a contactor/protection relay comprising in a casing 1 a plurality of double-contact power poles each accommodated in an interrupter chamber. To simplify the drawings only one pole is shown.

Each pole comprises a mobile contact bridge 21 carried by a contact holder 2 and carrying mobile contacts which cooperate with fixed contacts 31, 32 to make or break the passage of current between two connecting terminals connected to the fixed contacts. The contact holder 2 includes a plunger 22 and is guided for movement along a guide axis Z–Z'. A compression spring 23 compressed between the back of the interrupter chamber and the bottom of the contact holder 2 pushes the contact holder in the direction which closes the contacts.

The device includes a solenoid 4 housed in the casing 1 and acting on the upper part of the contact holder plunger 22. The solenoid 4 comprises a fixed magnetic circuit or yoke 41, a mobile magnetic circuit or armature 42 and a coil 43 connected electrically to terminals via a switch. The mobile armature 42 is connected by a pin 45 to an operating lever 44 which pivots on a pin 46 and bears on the top of the contact holder 2 in order to displace the latter. The mobile armature 42 of the solenoid is connected to a return spring 47.

A striker mechanism 5 is mounted in the casing to operate on the contact holder 2 in response to a short-circuit. This comprises a mobile core 51 or striker which is adapted to act on the contact holder 2 through the intermediary of an oscillating lever 52.

Each current path is associated with a magnetic and thermal protection module 6 including an instantaneous tripping magnetic device to protect against strong current surges and a thermal device adapted to provide protection against overloads and phase imbalance. If the module 6 detects an overload or a current surge on a current path it operates on the contact holder 2 through the intermediary of the operating lever 44.

All tripping or manual operation actions involve the actuator mechanism 7 which operates mechanically on a contact inside the device and connected in series with the coil 43 of the solenoid. The mechanism 7 can be operated manually by a control button 71 or automatically in response to instructions from the protection module 6. The various conditions of the mechanism are shown by the position of the operating button 71.

The plunger 22 has at its upper end an elastic device 8 on which the free end of the operating lever 44 coupled to the solenoid can bear. This elastic device comprises an end-piece 81 mounted at the upper end of the plunger 22 and a spring 82 compressed between the end-piece and the plunger. The free end of the lever 44 is adapted to bear on the top of the end-piece 81.

The elastic device 8 is provided with means for preventing the end-piece separating from the plunger 22. These means comprise a screw 84 fixed to the end-piece 81 and preventing it separating from the plunger 22. As an alternative, these means could comprise hook members cooperating with the plunger 22. The device comprises means for limiting travel of the end-piece towards the plunger 22. These means are formed by an abutment 83 disposed under the end-piece.

The operation of the device is described next.

When the coil is not excited, the armature 42 is held away from the yoke 41 by the return spring 47 and the operating lever 44 opens the contacts (FIG. 2).

Figure 3:
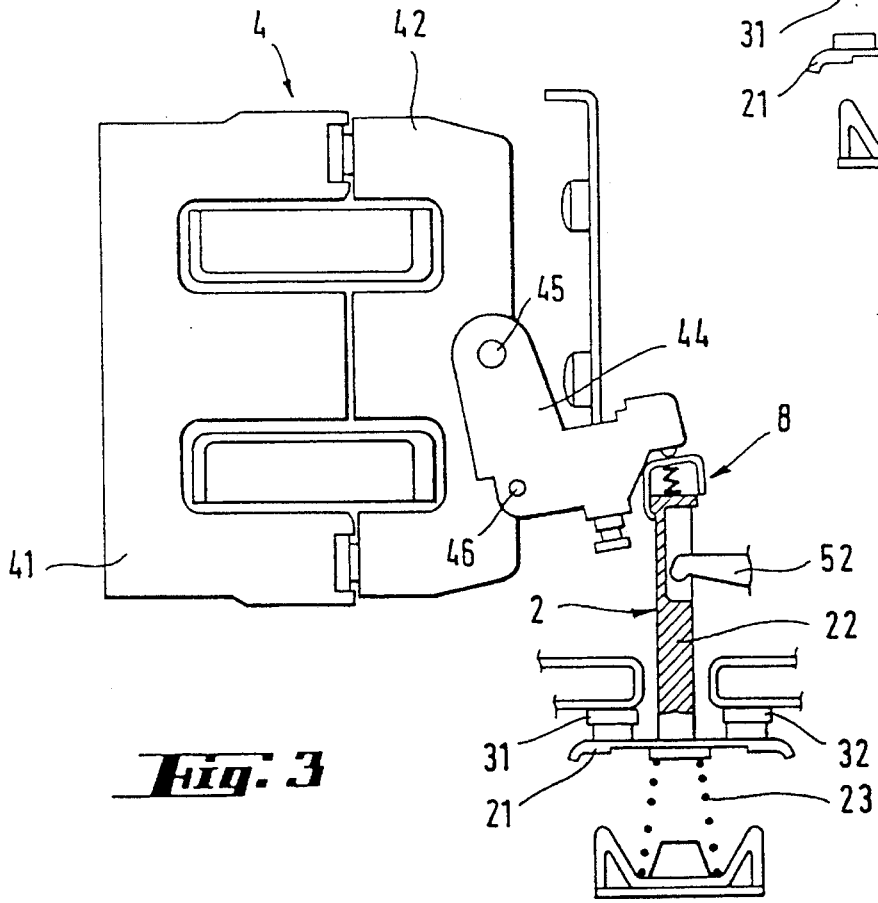
FIG. 3 is a view in cross-section of the contact operating mechanism with the contacts closed.

When the coil is excited the solenoid 4 closes and causes the operating lever 44 to rotate. The springs 23 at the back of the interrupter chamber are no longer compressed and the contacts are closed (FIG. 3).

The contacts can be opened by action at the control circuit of the coil 43 (for example by moving the operating button to the "OFF" position). If the coil 43 of the solenoid is no longer excited the solenoid opens and the operating lever 44 causes the poles to be opened.

Figure 4:
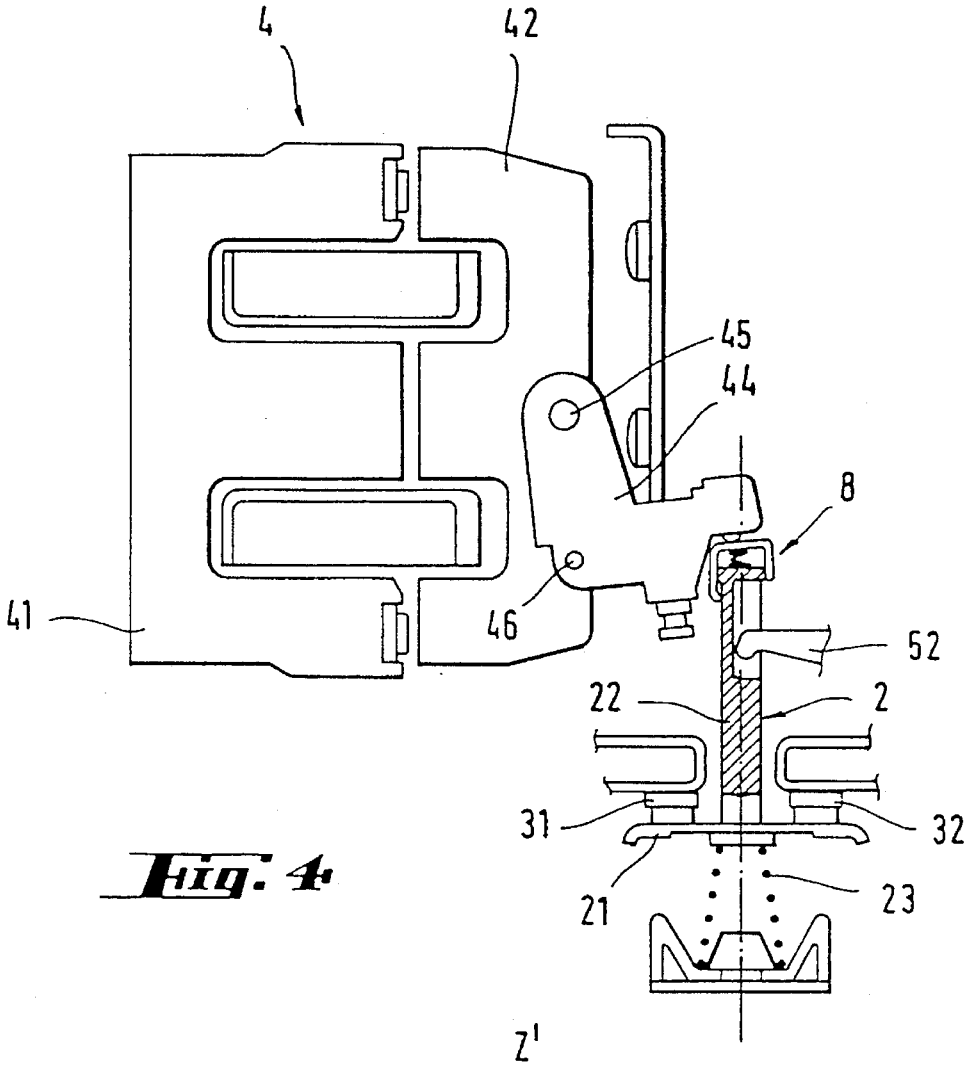
FIG. 4 is a view in cross-section of the contact operating mechanism the start of contact opening.
Figure 5:
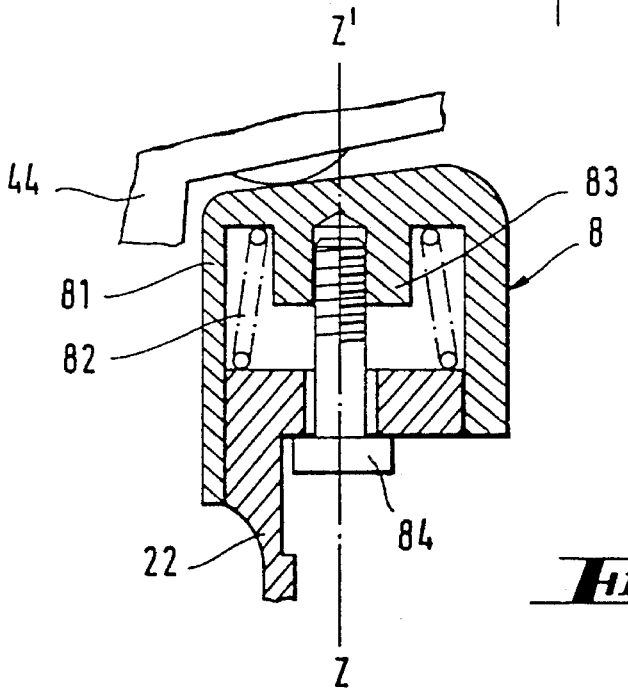
FIG. 5 is a more detailed view of the elastic device mounted on the contact holder.

The end of the operating lever 44 then bears on the end-piece 81. As the solenoid 4 opens the end-piece 81 moves inwards, compressing the spring 82 (FIG. 4).

The curve $C_1$ is FIG. 6 is the force/travel curve for the magnetic circuit without the poles (spring 47) and the curve $C_2$ is the force/travel curve for the magnetic circuit with the poles (spring 23). The straight line $C_3$ represents making of the contact. The curve $C_4$ shows the effect of the elastic device 8.

Of course, variants and changes in detail and even use of equivalent means are feasible without departing from the scope of the invention.

There is claimed:

1. A contactor/protector relay type protection switch comprising at least one power pole, said power pole comprising a mobile contact holder cooperating with fixed contacts, said mobile contact holder including a plunger; a solenoid comprising a fixed part and a movable part movable in directions toward and away from said fixed part; an operating lever coupled to said movable part of said solenoid, a portion of said lever arranged to engage said plunger to move said mobile contact holder with respect to said fixed contacts upon movement of said movable part of said solenoid in one of said directions; and an elastic device disposed between said portion of said lever and said plunger.

2. A switch according to claim 1 wherein said plunger including a free end, said elastic device comprises an end-piece mounted at said free end of said plunger and an associated spring compressed between said end-piece and said plunger.

3. A switch according to claim 1 wherein said elastic device has means for preventing separation of said end-piece and said plunger.

4. A switch according to claim 1 wherein said end-piece carries an abutment limiting its travel towards the plunger.

5. A switch according to claim 1 further comprising a striker mechanism adapted to operate on said contact holder.

* * * * *